US006128026A

United States Patent [19]

Brothers, III

[11] Patent Number: 6,128,026

[45] Date of Patent: Oct. 3, 2000

[54] DOUBLE BUFFERED GRAPHICS AND VIDEO ACCELERATOR HAVING A WRITE BLOCKING MEMORY INTERFACE AND METHOD OF DOING THE SAME

[75] Inventor: John W. Brothers, III, Palo Alto, Calif.

[73] Assignee: S3 Incorporated, Santa Clara, Calif.

[21] Appl. No.: 09/122,422

[22] Filed: Jul. 24, 1998

Related U.S. Application Data

[60] Provisional application No. 60/084,273, May 4, 1998.

[51] Int. Cl.[7] ..... G06F 13/00

[52] U.S. Cl. ..... 345/508; 345/521; 345/503

[58] Field of Search ..... 345/507, 508, 345/503, 521, 515, 516, 522

[56] References Cited

U.S. PATENT DOCUMENTS

| | | | |
|---|---|---|---|
| 5,450,542 | 9/1995 | Lehman et al. | 395/512 |
| 5,451,981 | 9/1995 | Drako et al. | 345/118 |
| 5,657,478 | 8/1997 | Recker et al. | 395/503 |
| 5,706,034 | 1/1998 | Katsura et al. | 345/508 |
| 5,764,964 | 6/1998 | Dwin et al. | 345/509 |
| 5,790,138 | 8/1998 | Hsu | 345/512 |
| 5,796,413 | 8/1998 | Shipp et al. | 345/522 |
| 5,966,142 | 10/1999 | Harkin | 345/522 |

*Primary Examiner*—Kee M. Tung
*Attorney, Agent, or Firm*—Fenwick & West LLP

[57] ABSTRACT

A write blocking accelerator provides maximum concurrency between a central processing unit (CPU) and the accelerator by allowing writes to the front buffer of a dual-buffered system. The CPU issues a series of drawing commands followed by a "page flip" command. When a command parser within the accelerator receives a page flip command, it notifies a screen refresh unit reading from the front buffer that the command was received. The screen refresh unit signals a memory interface unit (MIU) to enter a write blocking mode and provides the address of the current line in the front buffer from which the screen refresh unit is reading, and the address of the last line in the front buffer. The MIU blocks all writes from drawing engines that fall into the range defined between the two addresses. The screen refresh sends updated front buffer addresses to the MIU as display data is read out of the front buffer. Accordingly, the blocked address range constantly shrinks until all writes are allowed by the MIU. At that point, the screen refresh unit signals the MIU that it has reached vertical retrace and the MIU exits write blocking mode.

17 Claims, 3 Drawing Sheets

DOUBLE BUFFERED GRAPHICS AND VIDEO ACCELERATOR HAVING A WRITE BLOCKING MEMORY INTERFACE AND METHOD OF DOING THE SAME

This application claims the benefit of Provisional Application No. 60/084,273 filed May 4, 1998.

BACKGROUND OF THE INVENTION

1. Field of the Invention

This invention pertains in general to graphics and video processing hardware, and in particular to a memory interface between graphics and video processing engines and a frame buffer memory.

2. Description of Background Art

Modern computer systems execute programs such as games and multimedia applications that require extremely fast updates of graphics animation and video playback to the display. To this end, computer systems include accelerators designed to rapidly process and display graphics and video. Current accelerators, however, have bottlenecks that reduce the speed of the display updates.

One such bottleneck arises from the manner in which display images are rendered by the accelerator. An accelerator relies upon a display buffer to hold the data that are written to the display. Data are typically written to the display in a raster order: line-by-line from left to right and top to bottom. This order is due to the nature of a cathode ray tube (CRT) display in which an electron gun scans from the top-left toward the bottom-right of the display. Once the gun reaches the lower right of the display screen, a vertical retrace interval occurs as the gun moves back to the top-left.

Graphics data rendered by the accelerator, in contrast, are often not in raster order and may belong to any location in the display buffer. The accelerator, however, cannot write to the display buffer ahead of the scan line. Otherwise, the accelerator might overwrite a portion of the display buffer that had not yet been read out to the display and cause display artifacts like partially drawn images, commonly referred to as image tearing.

To avoid this problem, dual buffering systems have been developed that allow a graphics engine to write to one buffer while another buffer is being read to the display. FIG. 1 is a high-level block diagram illustrating a computer system having a dual buffering accelerator and a display. Illustrated are a central processing unit (CPU) 110 coupled to an accelerator 112 via a bus 114, and a display 116 coupled to the accelerator 112. Within the accelerator 112 are a graphics and video processing engine 118 and a display address register (DAR) 120. The accelerator 112 is further coupled to a display memory 122, which includes two screen buffers 124, 126.

The DAR 120 selectively identifies the starting address of a display buffer from which data is to be displayed following vertical retrace. The particular buffer so identified is conventionally referred to as a front buffer 124. The other buffer serves as a back buffer 126, and stores data for a frame being generated, that is, a frame not yet ready for display. While the accelerator 112 transfers data from the front buffer 124 to the display 116, the graphics engine 118 processes and executes commands received from the CPU 110, and writes data to the back buffer 126.

When the CPU 110 finishes sending the accelerator 112 commands for writing to the back buffer 126, the CPU 110 issues a page flip command. In response, the accelerator 112 writes the starting address of the back buffer 126 to the DAR 120, thereby identifying the current back buffer 126 as the next front buffer 124. In order to prevent image tearing, however, any data within the current front buffer 124 that has yet to be displayed must be read out and transferred to the display 116 before the roles of the current front and back buffers 124, 126 can be reversed. Thus, the roles of the current front and back buffers 124, 126 cannot be reversed until after vertical retrace has occurred.

The time interval between the DAR update and vertical retrace can be quite long—up to an entire screen refresh period. During this time interval, the CPU 110 cannot send graphics commands to the accelerator 112 because the current front buffer 124 is not yet ready to be used as the next back buffer 126. Thus, the graphics engine 118 is essentially idle between the DAR update and vertical retrace. The CPU 110 continuously polls the accelerator 112 to determine when a vertical retrace condition exists, and, accordingly, the CPU 110 can resume sending the accelerator 112 graphics and/or video processing commands. This polling is highly undesirable because it wastes CPU cycles. The polling also causes a high level of traffic on the bus 114, slowing the transfer of other data, such as texture data transferred from the computer system main memory (not shown) to the display memory 122.

One way to minimize graphics engine idle time and reduce CPU waiting and polling is to use additional buffers. For example, in conventional triple buffering, a first display buffer is used as a front buffer 124, while the graphics engine 118 writes data into a second buffer. In response to a page flip command, the graphics engine 118 begins writing data into a third buffer. Upon vertical retrace, the second buffer is treated as the front buffer 124, while the first buffer becomes the next buffer used for rendering.

Triple buffering solutions still require a means for ensuring that successively-received page flip commands do not result in writing graphics or video data into the current front buffer 124. In general, however, triple buffering may provide enough buffering that the CPU 110 may essentially never need to interrupt the issuance of commands to the accelerator 112. Unfortunately, the use of an additional buffer consumes display memory 122 and reduces the amount of memory available for other purposes.

What is needed is a means for minimizing graphics/video engine and CPU idle time while also minimizing bus bandwidth consumption in determining when vertical retrace has occurred, without consuming additional display memory.

SUMMARY OF THE INVENTION

The above needs are met by an accelerator that allows engines to write into a front buffer behind the scan line. A preferred embodiment of the present invention has a bus interface unit (BIU) coupled to a central processing unit (CPU) of a computer system. The BIU is coupled to a command queue, a command parser and master control unit (CPMC), and a plurality of engines, including 2- and 3-dimensional graphics rendering engines and a video decompression engine. The CPMC and the engines are coupled to a memory interface unit, which, in turn, is coupled to a frame buffer or video memory. Preferably, the frame buffer is coupled via one or more channels to a main or system memory, and may be shared between multiple agents. The frame buffer includes a front buffer and a back buffer. A screen refresh unit (SRU) is coupled to the CPMC, the frame buffer, and a display.

The CPU generates drawing and control commands, and asynchronously sends them to the command queue via the BIU. The BIU is preferably coupled to the CPU via a Peripheral Component Interconnect (PCI) bus or a dedicated graphics coupling such as an Accelerated Graphics Port (AGP). The command queue is a first-in-first-out buffer or queue that stores the CPU commands. The CPMC reads each command from the command queue, parses the command to determine its type, and then dispatches the command to the appropriate engine. Additionally, the CPMC coordinates and controls each engine, and synchronizes interactions between the engines.

The engines process drawing commands and generate display data to be written to the frame buffer. Before writing to the frame buffer, the engines request permission from the MIU. The MIU arbitrates writes to the frame buffer, and allows the engines to write unless the MIU is in a write blocking mode as described below. The SRU reads the display data from the front buffer in a raster order and displays the data on the display.

The CPU typically generates a list of drawing commands that direct one or more engines to write within the back buffer, followed by a "page flip" command telling the accelerator to switch the roles of the front and back buffers. The CPU then generates another list of commands for the engines to execute. When the CPMC parses the page flip command, the CPMC signals the SRU that a page flip command was received. The SRU, in turn, signals the MIU to enter write blocking mode and provides an address indicating the current line being read by the SRU and an address indicating the end of the front buffer. The MIU blocks all writes to the front buffer within the range defined by the addresses provided by the SRU, but allows writes to the front buffer behind the blocked address range. The SRU sends an updated line address to the MIU as the SRU reads each line in the buffer, or periodically sends such an address (line or otherwise) to the MIU, and then draws the line to the display. Accordingly, the blocked address range continuously shrinks until vertical retrace occurs, at which point the length of the address range is zero and all writes are allowed. At vertical retrace, the SRU signals the MIU to exit write blocking mode.

When an engine indicates to the MIU that it wishes to write to an address in the front buffer within the blocked range, the MIU does not grant write permission to the engine until the SRU has moved to the display data that lies beyond the address to which the engine will write.

The write blocking provided by the present invention maximizes parallelism between the CPU and the accelerator by shifting synchronization tasks from the CPU to the accelerator. In addition, write blocking maximizes the time that the engines are kept running after page flips and before vertical retrace, thereby also maximizing parallelism between the drawing engines' operation and the occurrence of screen refresh.

DETAILED DESCRIPTION OF THE PREFERRED EMBODIMENTS

Figure 1:
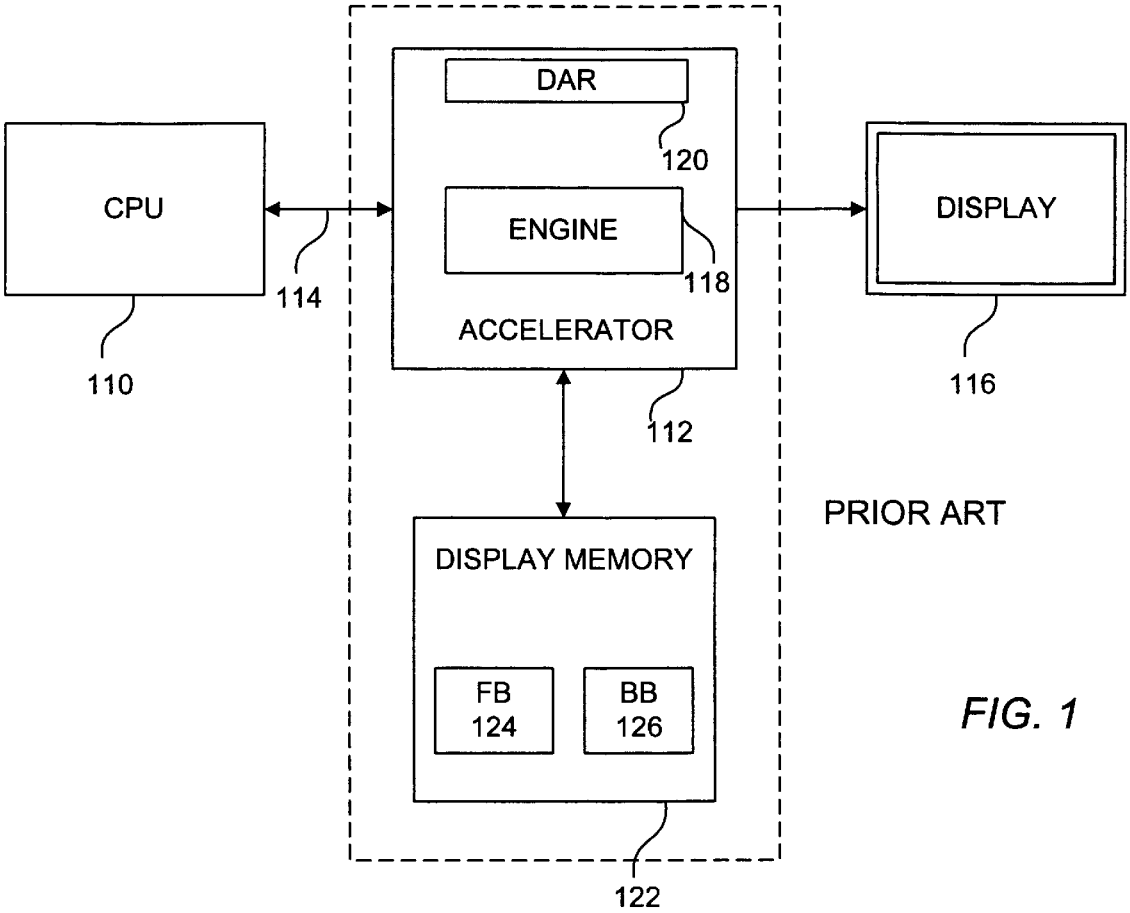
FIG. 1 is a high-level block diagram illustrating a computer system having a dual buffered accelerator and a display.
Figure 2:
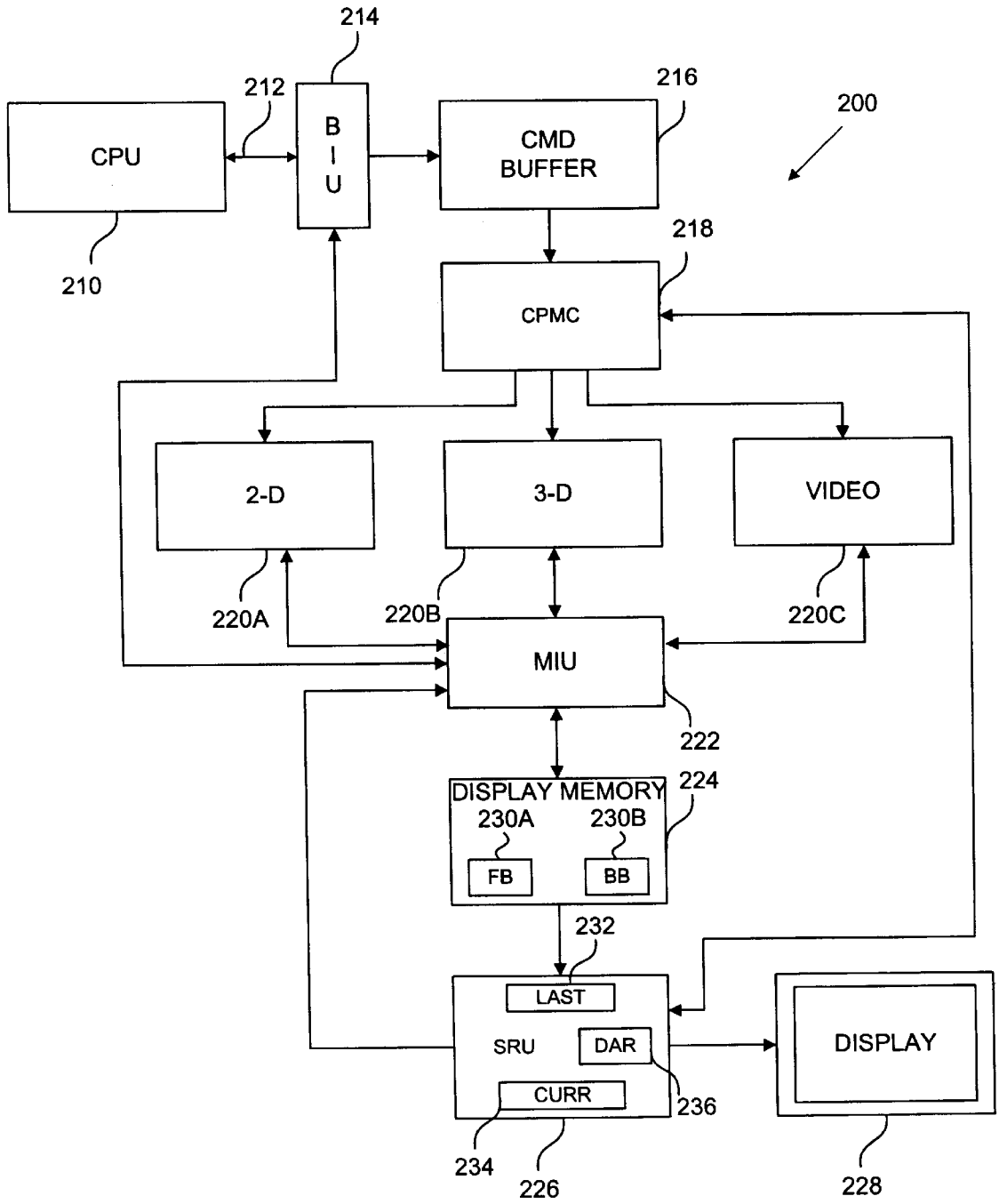
FIG. 2 is a block diagram illustrating selected components of a computer system and a write blocking accelerator constructed according to a preferred embodiment of the present invention.

FIG. 2 is a block diagram illustrating a preferred embodiment of a write blocking accelerator 200 coupled to a computer system and constructed in accordance with the present invention. Shown are a Central Processing Unit 210 (CPU) coupled via a graphics bus 212 to a Bus Interface Unit 214 (BIU), which, in turn, is coupled to a command queue 216 and a Command Parser/Master Control Unit 218 (CPMC). A set of processing engines 220, preferably including a two-dimensional (2-D) graphics engine 220A, a three-dimensional (3-D) graphics engine 220B, and a video decompression engine 220C are coupled to the CPMC 218. The engines 220 and CPMC 218 are coupled to a Memory Interface Unit 222 (MIU), which, in turn, is coupled to a frame buffer or video memory 224. A Screen Refresh Unit 226 (SRU) and an associated display 228 are coupled to the frame buffer 224. The SRU 226 is also coupled to the CPMC 218 and the MIU 222.

The CPU 210 sends command sequences to the accelerator 200. The CPU 210 is preferably a general purpose processor such as a Pentium II microprocessor manufactured by Intel Corporation of Santa Clara, Calif. As used herein, commands include 1) drawing commands that specify manners in which graphical and/or video data is to be manipulated, animated, and/or displayed, 2) page flip commands; and 3) control commands that specify parsing or execution timing instructions, and status communication instructions.

A typical command sequence generated by the CPU 210 includes a list of drawing commands, a "page flip" command telling the accelerator 200 to perform a buffer swap after vertical retrace, and then more drawing commands. By rapidly flipping pages (i.e., performing buffer swaps), the accelerator 200 animates the image on the display 228. The CPU 210 preferably issues commands asynchronously, i.e., in a "fire-and-forget" manner, to the accelerator 200.

The graphics bus 212 transmits commands from the CPU 210 to the BIU 214 and is preferably a dedicated graphics coupling such as an Accelerated Graphics Port (AGP). However, the graphics bus 212 may also be a standard Peripheral Component Interconnect (PCI) or other type of bus or coupling. The graphics bus 212 also carries or transfers textures and other graphics data from the main memory of the computer system (not shown), and transfers status information to the host CPU 210. As used herein, the term "graphics" includes both graphical and video information. Thus, the graphics bus 212 may carry video, as well as graphical, data.

The BIU 214 receives the data and commands transmitted over the graphics bus 212. In the preferred embodiment, the BIU 214 can perform on-demand data transfers via bus mastering, in a manner that will be readily understood by those skilled in the art. The BIU 214 sends drawing and page flip commands received over the graphics bus 212 to the command queue 216, and other data, such as texture information, to the frame buffer 224. The command queue 216 comprises a first-in-first-out (FIFO) buffer that stores drawing commands received from the CPU 210. The command queue 216 is preferably large enough that it essentially never gets full and the CPU 210 can always send commands to the accelerator 200.

Via the command queue 216, the present invention buffers page flip commands received from the CPU 210. Through page flip command queuing and the write blocking operations described in detail below, the accelerator 200 manages data transfers into and out of the frame buffer 224, in a manner that enables the CPU 210 to successively issue drawing and page flip commands without concern for whether vertical retrace has occurred.

The CPMC 218 reads each drawing command out of the command queue 216, and determines to which engine 220 the command applies. Next, the CPMC 218 activates the appropriate engine 220 and dispatches the command thereto. The CPMC 218 continues to dispatch commands to that engine 220 until the CPMC 218 parses a command applying to another engine 220. At that point, the CPMC 218 dispatches the command to the other engine 220.

As mentioned above, the preferred write blocking accelerator 200 includes multiple engines 220, including a 2-D engine 220A, a 3-D engine 220B, and a video decompression engine 220C. The 2-D 220A and 3-D 220B engines respectively process 2-D and 3-D drawing commands. The video decompression engine 220C processes and decompresses data stored in a video format, such as a Motion Pictures Expert Group (MPEG) format.

When an engine 220 receives a command from the CPMC 218, the engine 220 processes the command and generates display data that will subsequently be used to update a location on the display 228. Graphical display data from the 2-D and 3-D engines may be intended for any given location on the display 228 and is generally not generated by the engines 220A, 220B in raster order, i.e., left-to-right, top-to-bottom. However, certain rendering techniques like strip rendering, in which the display image is rendered from top to bottom in horizontal strips, may be used by the engines 220A, 220B to generate graphical display data in raster order. Video display data from the video decompression engine 220C, in contrast, is usually generated in raster order.

The MIU 222 controls the engines' access to the frame buffer 224. The frame buffer 224 includes two buffers 230. At any given time, one of the buffers 230 acts as a front buffer 230A while the other acts as a back buffer 230B. The front buffer 230A stores display data that is currently being displayed, while the back buffer 230B stores display data that is currently being rendered, or "under construction."

The engines 220 preferably send the display data to the MIU 222 via a handshaking protocol. First, the sending engine 220 issues a write request to the MIU 222 along with the starting and ending addresses in the buffer 230 to which it will write. The MIU 222 processes the request and, if the address range is available for writing as described in detail below, sends an acknowledgment signal to the engine 220. The engine 220 idles until it receives the acknowledgment, and then writes the data to the buffer 230.

Prior to receipt of a page flip command, display data from the engines 220 write to the current back buffer 230B while the SRU 226 reads display data from the current front buffer 230A and draws to the display 228. The SRU 226 reads display data from the front buffer 230A in raster order; passes the data through a digital to analog converter (not shown) in a conventional manner; and then transfers the data to the display 228, in a manner that will be readily understood by those skilled in the art.

In response to a page flip command, the present invention enters a write blocking mode, in which the engines 220 write display data to the current front buffer 230A while the SRU 226 transfers current image data from the front buffer 230A to the display 228. While in write blocking mode, writes to the front buffer 230A occur behind the beam or scan line, thereby preventing the occurrence of discontinuities or artifacts in the displayed image. In an alternate embodiment, the present invention could always operate in the write blocking mode, thus preventing writes to the undisplayed portion of the front buffer 230A. Those skilled in the art will recognize, however, that such writes would normally be attempted only after a page flip command.

The SRU 226 includes a last address register 232 and a next address register 234, which are utilized while in write blocking mode. The last address register 232 preferably stores the starting address of the line after the last line within the current front buffer 230A, and the next address register 234 preferably stores the starting address of the data corresponding to the next scan line to be displayed. Those skilled in the art will recognize that an alternate embodiment could employ a current address register, which would store the starting address of the data corresponding to the current scan line being displayed, rather than the next address register 234. In addition to the last and next address registers 232, 234, the SRU 226 also includes a display address register (DAR) 236, the contents of which identify the current front buffer 230A. The detailed operations performed by the present invention, including the manners in which the next and last address registers 232, 234 are utilized during write blocking, are described hereafter.

Figure 3:
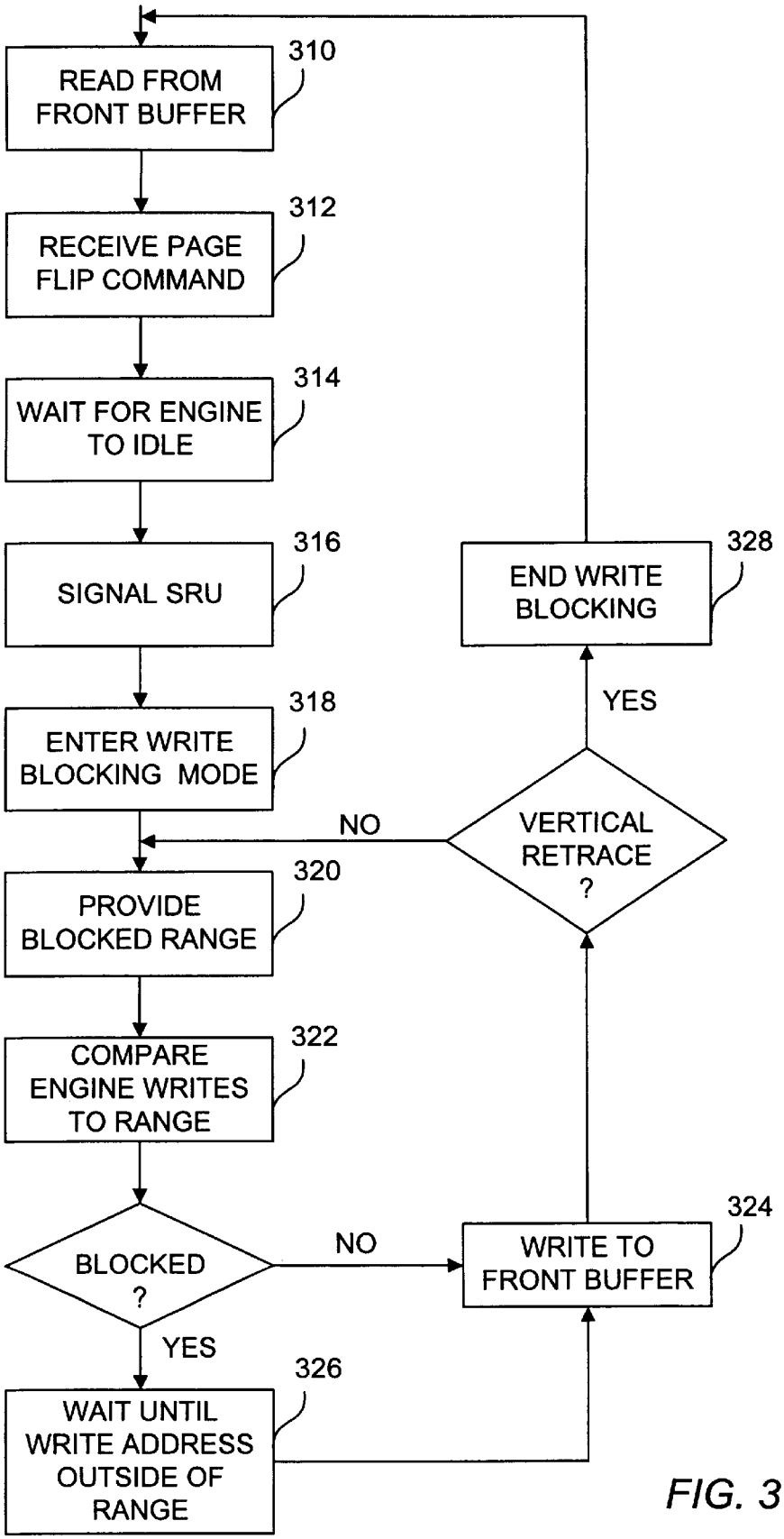
FIG. 3 is a flowchart showing preferred write blocking accelerator operation in accordance with the present invention.

FIG. 3 is a flowchart showing a preferred method of write blocking accelerator operation in accordance with the present invention. The method begins in step 310 with the SRU 226 drawing to the display 228 using the contents of the front buffer 230A. The SRU 226 preferably reads and outputs display data a scan line at a time, in the manner previously described. Concurrent with the activity of the SRU 226, the CPMC 218 processes commands stored in the command queue 216. The presence of a page flip command indicates that the roles of the front and back buffers 230A, 230B are to be reversed. When the CPMC 218 receives or retrieves a page flip command 312 from the command queue 216, the CPMC 218 waits for the currently executing engine 220, or any other engine 220 that might write data into the frame buffer 224, to idle 314, thereby ensuring that the construction of the next image to be displayed has been completed. Next, the CPMC 218 signals the SRU 226 that it has received a page flip command 316.

In response, the SRU 226 initializes or sets the values in the last and next address registers 232, 234; signals the MIU 222 to enter write blocking mode; and provides the MIU 222 with the contents of the next address register 234 318. The SRU 226 then continues to transfer display data from the front buffer 230A to the display 228. Each time the SRU 226 reads a line of display data, the SRU 226 preferably increments the next address register's value and transfers the updated next address value to the MIU 222 320. Those skilled in the art will recognize that in an alternate embodiment, the SRU 226 could transfer updated next address values to the MIU 222 at a particular, or even variable, frequency other than that related to line-by-line data transfer, such as on a byte-by-byte or group-of-lines basis. Accordingly, the blocked address range shrinks as the SRU 226 moves or advances through the front buffer 230A.

The MIU 222 treats addresses beyond that specified by the next address value (i.e., addresses within the range defined by the contents of the next and last address registers 234, 232) as blocked, into which writes are prohibited. The MIU 222 checks the address ranges of the write requests received from the engines 220 against the next address value received from the SRU 226. Writes to addresses behind the blocked range—that is, writes directed to front buffer addresses for which display data has already been transferred to the display 228—are allowed to proceed 324. Additionally, writes to other parts of the frame buffer 224, such as a Z-buffer, are allowed to proceed.

If an engine 220 attempts to write to an address within the blocked address range, the MIU 222 preferably waits until the SRU 226 issues or provides a next address value that exceeds or lies beyond the addresses to which the engine 230 will write, after which the MIU 222 provides a handshaking signal to the engine 220, thereby allowing the engine to write to the front buffer 230A.

In an alternate embodiment, the MIU 222 could accept valid writes from other engines 220 while the blocked engine 220 idles. In another alternate embodiment, the MIU 222 would not respond to the handshaking request from a blocked engine 220 until after a vertical retrace has occurred 326 and the front and back buffers 230A, 230B are swapped.

Write blocking mode ends after the SRU 226 has transferred the last line of display data from the current front buffer 230A to the display 228 and vertical retrace has occurred, in which case the SRU 226 updates the contents of the DAR 236 and signals the MIU 222 to exit write blocking mode 328. The preferred method then returns to step 310.

One advantage of the present invention is that the engines 230 process as many commands as possible without writing ahead of the scan line or beam, thereby ensuring that the displayed image remains unaffected. Accordingly, the accelerator 200 achieves maximum concurrency with the rest of the computer system. Another advantage of the current invention is that the CPMC 218 hardware is simplified because it only needs to notify the SRU 226 of a page flip and then send subsequent commands to the appropriate engines 220, rather than parse the command and determine the address range to which it will write. A corresponding advantage is that the present invention works with any type of graphics or video engine 220. Yet another advantage is that the CPU 210 does not need to poll the accelerator 200 to determine when vertical retrace has occurred, thereby aiding efficient utilization of graphics bus bandwidth and avoiding the consumption of CPU processing bandwidth.

While the present invention has been described with reference to certain preferred embodiments, those skilled in the art will recognize that variations and modifications may be provided. For example, the teachings of the present invention can be applied to triple buffering environments, in which one of three buffers serves as the front buffer at any given time. In a triple buffering implementation, the present invention provides for writing into the front buffer behind the beam or scan line after the issuance of a page flip command but before vertical retrace, in a manner analogous to that described above. The description herein provides for such variations and modifications to the present invention, which is limited only by the following claims.

What is claimed is:

1. A method for updating, in response to drawing commands, a front buffer and at least one back buffer within a display memory in a computer system having a display, the method comprising the steps of:

reading display data from a first address in the front buffer to the display; and responsive to receiving a drawing command for writing to a second address:

allowing the write to the second address if the second address is in the at least one back buffer;

allowing the write to the second address if the second address is in the front buffer and before the first address; and blocking the write to the second address if the second address is in the front buffer and beyond the first address.

2. The method of claim 1, wherein the blocking step allows the blocked write to the second address to proceed after display data from an address in the front buffer beyond the second address is read to the display.

3. The method of claim 1, wherein the blocking step blocks the write to the second address until a vertical retrace occurs.

4. The method of claim 1, further comprising the step of allowing a write to another address in the front buffer while blocking the write to the second address.

5. The method of claim 1, wherein the first address increases as display data is read from the front buffer to the display, and the blocking step further comprises the steps of:

monitoring increases in the first address; and allowing the blocked write to the second address in the front buffer to proceed after the first address increases past the second address.

6. The method of claim 1, further comprising the steps of:

receiving a signal indicating a target address range to which the drawing command will write, wherein the second address is within the target address range;

determining a blocked address range in the front buffer; and determining whether the second address is within the blocked address range.

7. The method of claim 6, wherein the step of determining a blocked address range comprises the substeps of:

determining the first address from which the display data is being read from the front buffer to the display; and determining a last address in the front buffer, wherein the blocked address range is bounded by the first address and the last address.

8. The method of claim 1, further comprising the steps of:

responsive to receiving a page flip command, identifying a buffer to which a subsequent drawing command will write; and determining whether the buffer to which the subsequent drawing command will write is the front buffer.

9. An accelerator for updating a display, the accelerator comprising:

a front buffer for storing display data for displaying on the display;

at least one back buffer for storing display data;

a screen refresh unit coupled to the front buffer and the display, for reading display data at a first address in the front buffer and writing the display data to the display;

a first engine responsive to drawing commands, for generating display data and writing the generated display data to a second address; and a memory interface unit coupled to the front buffer, the at least one back buffer, and the first engine, for:

allowing the first engine to write to the second address if the second address is in the at least one back buffer;

allowing the first engine to write to the second address if the second address is in the front buffer and before the first address; and blocking the first engine from writing to the second address if the second address is in the front buffer and after the first address.

10. The accelerator of claim 9, further comprising a command queue for storing drawing and page flip commands, the command queue coupled to the first engine.

11. The accelerator of claim 10, further comprising a command parsing unit coupled to the command queue and the first engine, for parsing and dispatching drawing commands.

12. The accelerator of claim 11, further comprising a bus interface unit coupled to the command queue, for receiving commands from a processing unit and storing the commands in the command queue.

13. The accelerator of claim 9, wherein the screen refresh unit comprises a first address register for storing the first address.

14. The accelerator of claim 13, wherein the screen refresh unit further comprises a second address register for storing an address corresponding to a last address within the front buffer.

15. The accelerator of claim 9, wherein the screen refresh unit updates the first address as the screen refresh unit writes the display data at the first address to the display and wherein if the second address is in the front buffer and before the first address, the memory interface unit blocks the first engine from writing to the second address until the screen refresh unit updates the first address to an address after the second address.

16. The accelerator of claim 15, further comprising:

a second engine responsive to drawing commands, for generating display data and writing the generated display data to a third address in the front buffer, the second engine coupled to the memory interface unit, wherein the memory interface unit allows the second engine to write to the third address if the third address is before the first address, while blocking the first engine from writing.

17. The accelerator of claim 9, wherein if the second address is after the first address, the memory interface unit blocks the first engine from writing until a vertical retrace occurs.

* * * * *